United States Patent [19]

Choisel

[11] 4,146,211

[45] Mar. 27, 1979

[54] DEVICE FOR JOINING PARTITIONS AND DOORS TO POSTS

[76] Inventor: Daniel Choisel, 2, rue de la Muette "Les Bas-Buissons", 28100 Dreux (Eure-et-Loir), France

[21] Appl. No.: 908,462

[22] Filed: May 22, 1978

[30] Foreign Application Priority Data

May 23, 1977 [FR] France ..... 77 15720

[51] Int. Cl.[2] ..... E04H 17/16

[52] U.S. Cl. ..... 256/26

[58] Field of Search ..... 16/151, 129, 128 R, 16/86.1, 86.2, 137, 138; 160/135; 256/25, 26, 27; 119/20; 40/125

[56] References Cited

U.S. PATENT DOCUMENTS

| | | | |
|---|---|---|---|
| 1,706,388 | 3/1929 | Ashkenas | 160/135 |
| 1,744,605 | 1/1930 | Ashkenas | 160/135 X |
| 3,428,108 | 2/1969 | Singer | 160/135 |

*Primary Examiner*—Werner H. Schroeder
*Assistant Examiner*—C. J. Arbes
*Attorney, Agent, or Firm*—Cushman, Darby & Cushman

[57] ABSTRACT

The invention relates to a device for joining partitions and doors to posts.

The device comprises sleeves each having an octagonal profile which are mounted and fixed on posts to present faces each having two tapped holes. Against these faces brackets can be fixed for holding partitions or hinges can be fixed by way of a fastening lug. Each hinge also has means for fastening to a door.

The invention is particularly useful for the rapid erection of boxes from completely prefabricated elements.

6 Claims, 4 Drawing Figures

DEVICE FOR JOINING PARTITIONS AND DOORS TO POSTS

BACKGROUND OF THE INVENTION

The invention relates to a device for joining partitions and doors, which bound enclosed spaces, to posts. The invention relates more particularly, but not exclusively, to boxes or stalls used inside a larger building to define sites reserved collectively or individually for animals, and particularly for saddle-horses.

DISCUSSION OF THE PRIOR ART

There are already known on the market numerous types of internal boxes which are composed essentially of partitions and doors fixed to posts. It has been attempted to rationalise their construction by standardising various elements, such as posts, partition panels, and doors. However, in order to make the best possible use of the space available in buildings, which are sometimes old, for the purpose of installing boxes therein, it is often necessary to give these boxes a perimeter which follows variable contours. The partitions and door frames then form together variable dihedra of which the posts are the apices. This has the consequence that the door hinges and fastening lugs of the partitions are fixed to the posts at variable points on the circumference of the latter. This makes it impossible for the posts to be completely prefabricated in advance together with the hinges and fastening lugs.

SUMMARY OF THE INVENTION

The invention seeks to eliminate this disadvantage and to make it possible for all the component elements of the boxes, including the posts, to be completely manufactured in advance without losing the ability to construct boxes in accordance with any desired perimeter on the ground, since installation in position requires only the use of screws.

According to the present invention there is provided a device for joining partitions and doors to posts, comprising a plurality of sleeves, each said sleeve having an inner profile corresponding to the outer profile of the posts, each said sleeve having an outer profile of polygonal shape presenting a plurality of faces each facing in a different direction, each face having at least two tapped holes spaced apart longitudinally; a plurality of brackets, each said bracket having two arms, at least one of said arms being identical with at least one of said faces of each sleeve and having two spaced holes, the other arm of each said bracket being arranged to be fixed to a partition; and a plurality of hinges, each said hinge being composed of a male part and a female part, said male part comprising a plate and a pivot pin carried by said plate, said female part comprising a plate having an opening therein for receiving said pivot pin, wherein one of the male part of female part is provided with a fastening lug, said lug being identical with at least one of said faces of each said sleeve and having two spaced holes, and wherein the other of said male part or female part carries means arranged to be fastened to a door.

The doors are preferably made from a frame having tubular uprights of square section, and the aforesaid means for fastening a part of each hinge to a door is a member of square section which can be inserted into the tubular sections of the door frames.

In one embodiment of the invention the sleeves have an octagonal outer profile; this makes it possible to dispose the partitions and the doors in eight different directions. Three sleeves are preferably provided for mounting on the same post, at three suitable respective levels.

BRIEF DESCRIPTION OF THE DRAWINGS

An embodiment of the present invention will hereinafter be described, by way of example, with reference to the accompanying drawings, in which.

DESCRIPTION OF A PREFERRED EMBODIMENT

Figure 3:
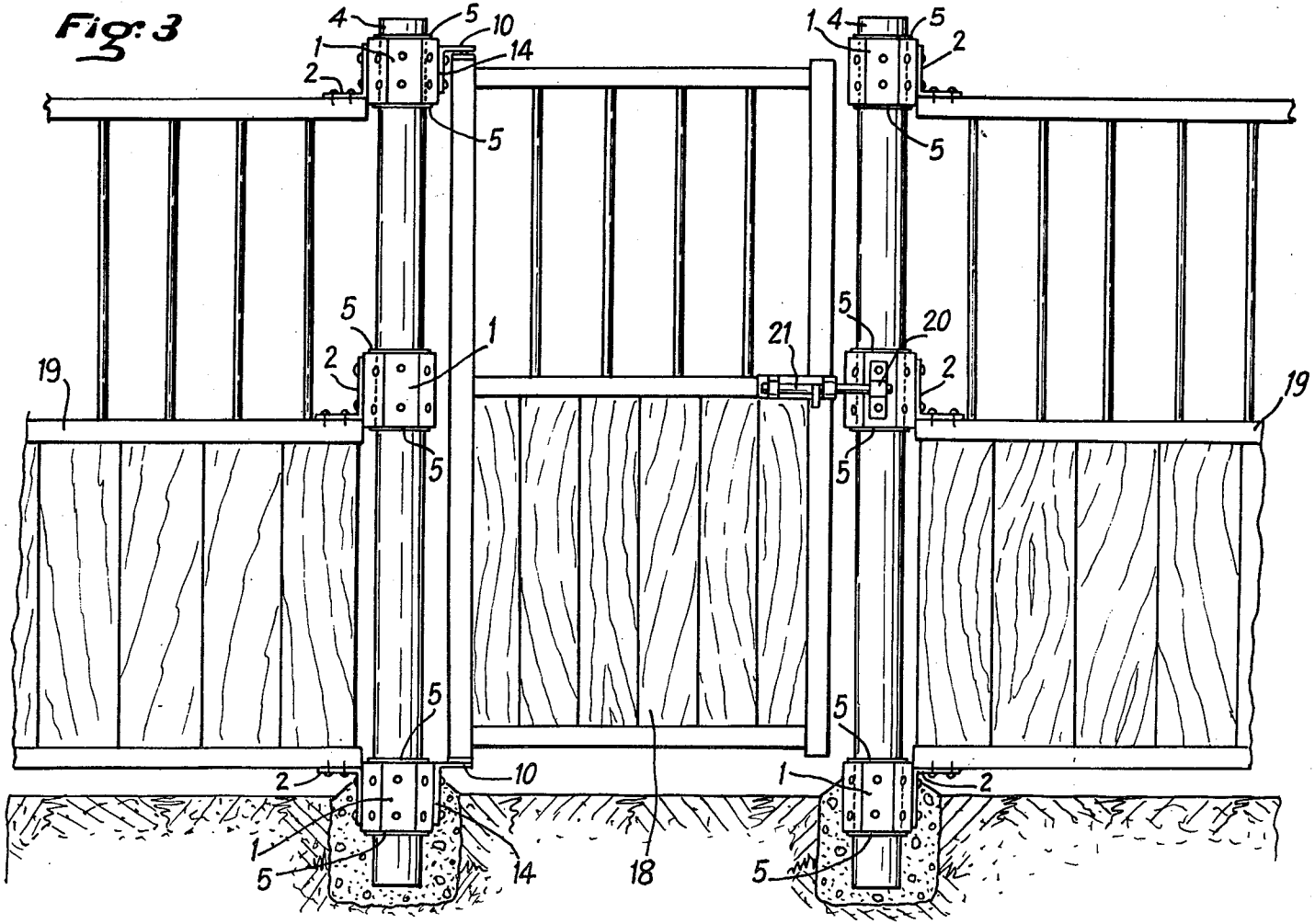
FIG. 3 shows an elevation of a door, two partitions, and two posts joined together by means of a device of the invention.

A joining device of the invention comprises a sleeve 1, brackets as 2, and hinges 3 each having a male part and a female part. Each sleeve 1 has an inner profile which corresponds to the outer profile of posts 4 (FIGS. 3 and 4) along which the sleeves are intended to be mounted and fixed. For example, where the posts 4 are tubes having a circular outer profile, the sleeves 1 have a circular inner cross-secton, with a diameter such that they can easily slide along the posts 4. The sleeves 1 are fastened on the posts 4 at the desired height by any suitable means, for example by weld beads 5 on their outer faces. Each sleeve 1 has an outer profile which in cross-section is polygonal in shape; in the present example this profile is octagonal, so that each sleeve has eight narrow, elongated outside faces 6. Each face 6 has pierced in it two tapped holes 7 spaced apart in the longitudinal direction. The brackets 2 are preferably right angled with two identical arms 8, which each have the same dimensions as each of the rectangular faces 6. In each arm 8 two holes 9 are provided, the holes 9 being spaced apart in the longitudinal direction, in the same manner as tapped holes 7 provided in the sleeve 1. Each hinge 3 comprises a male part having a plate 10 provided with a pivot pin 11, and a female part having a plate 12 which is preferably identical to the plate 10. The plate 12 has an aperture 13 designed to receive the pivot pin 11 of the plate 10. One of the male and female parts, in this example the male part, although it could be the female part, is provided on one side of the plate 10 with an attachment lug 14 identical to an arm 8 of a bracket 2 and likewise provided with two spaced holes 15. The lug 14 can be fixed against any of the faces 6 of a sleeve 1, the pivot pin 11 of the hinge then being substantially vertical. The female part of each hinge is provided on one face of the plate 12 with a suitable means 16 for fastening to a door 18.

Figure 1:
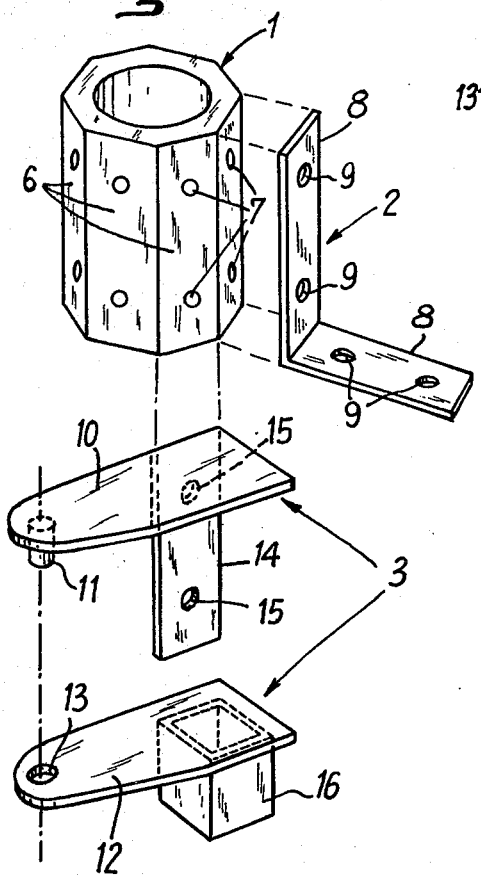
FIG. 1 shows an exploded perspective view of the main components of a device of the invention.
Figure 2:
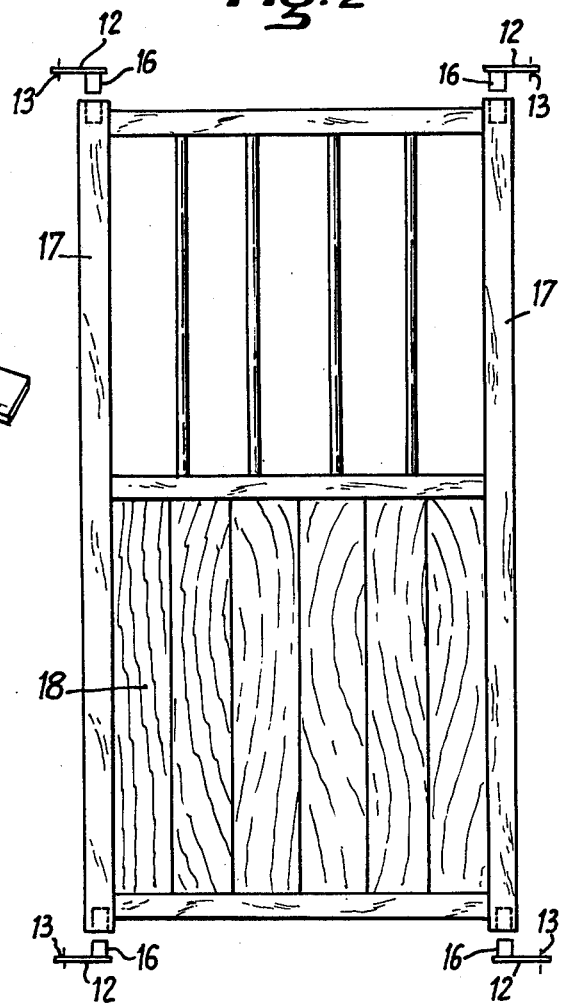
FIG. 2 shows an elevation of a door with the hinge parts shown in various installed positions.

In the embodiment illustrated the doors 18 each have a frame comprising uprights 17 formed of tubes of a square cross-section, and so the means 16 of each female part of the hinges is a member having a square profile and dimensions enabling it to be easily introduced into a socket at the end portion of an upright 17. Thus, the same member 16 may be inserted into a socket at either the top end or the bottom end of any left-hand or right-hand upright 17. Any opening direction can thus be selected for a door 18, without any local adaptation work, as indicated in FIG. 2.

The device of the invention makes it possible for the doors 18, partitions 19, or assembled partition elements, and the posts 4, on each of which three sleeves 1 have for example been fixed at the desired levels, to be completely prefabricated in advance. For given animals, for example horses, the height of the doors 18 and the partitions 19 is in fact determined in advance, as well as the height of a bottom, solid portion and an upper barred portion of these partitions. After the posts 4 have been anchored in the ground with the desired spacing, each sleeve 1 has eight available faces 6 for receiving either an arm 8 of a bracket 2, whose other arm is fixed on an end face of a partition 19, or for receiving a fastening lug 14 of a male part of a hinge. If three sleeves 1 are fixed on each post 4 the partitions 19 can be solidly fastened at three spaced points and each door 18 can be held between two pivots. One face 6 of an intermediate sleeve 1 can also serve for fastening a staple 20 suitable for receiving a bolt 21 mounted on the door 18.

Figure 4:
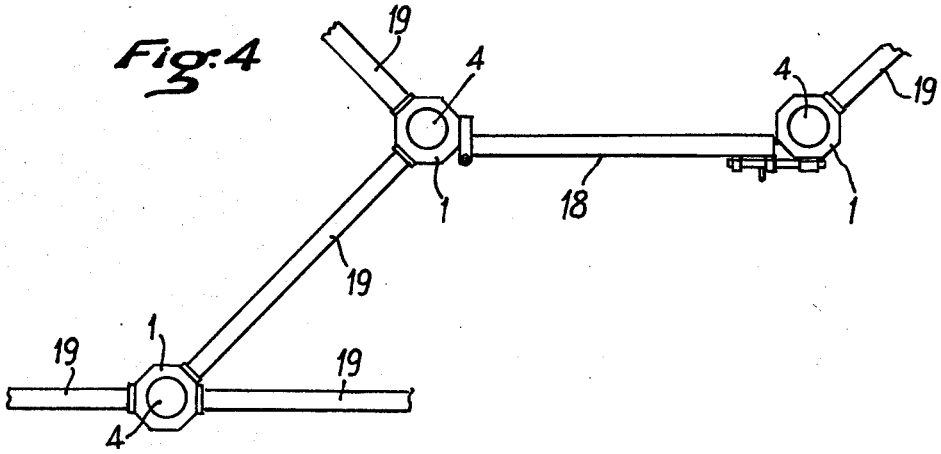
FIG. 4 shows a plan view from above of posts and partitions joined together in a complex arrangement by way of devices of the invention.

The device of the invention permits a great variety of door and partition arrangements to be made with the aid of completely prefabricated elements, as illustrated in FIG. 4. One sleeve 1 on one post 4 can obviously be used for the fastening of a plurality of partitions 19 and a plurality of doors 18 if so desired.

What I claim is:

1. A device for joining partitions and doors to posts, comprising a plurality of sleeves, each said sleeve having an inner profile corresponding to the outer profile of the posts, each said sleeve having an outer profile of polygonal shape presenting a plurality of faces each facing in a different direction, each face having at least two tapped holes spaced apart longitudinally; a plurality of brackets, each said bracket having two arms, at least one of said arms being identical with at least one of said faces of each sleeve and having two spaced holes, the other arm of each said bracket being arranged to be fixed to a partition; and a plurality of hinges, each said hinge being composed of a male part and a female part, said male part comprising a plate and a pivot pin carried by said plate, said female part comprising a plate having an opening therein for receiving said pivot pin, wherein one of the male part or female part is provided with a fastening lug, said lug being identical with at least one of said faces of each said sleeve and having two spaced holes, and wherein the other of said male part or female part carries means arranged to be fastened to a door.

2. A device according to claim 1, wherein each said sleeve has in cross-section an octagonal profile.

3. A device according to claim 1, wherein said means for fastening one part of each said hinge to a door is a member having a profile and dimensions arranged to permit easy insertion of said member into a corresponding socket provided in the door.

4. A device according to claim 1, wherein said means for fastening one part of each said hinge to a door is a member arranged to be easily inserted into the end portions of tubular uprights of a door.

5. A device according to claim 4, wherein in each said hinge the plate of the male part is provided with the fastening lug, and the plate of the female part is provided with a member adapted to be introduced into the tubular uprights of a door.

6. A device according to claim 1, wherein three said sleeves are arranged to be fixed on one post at suitable levels.

* * * * *